US006513413B2

(12) United States Patent
Lee

(10) Patent No.: US 6,513,413 B2
(45) Date of Patent: Feb. 4, 2003

(54) MOLD-PRESSING DEVICE

(76) Inventor: Cheng Ho Lee, 5F, No. 12, Alley 29, Lane 10, Sec. 3., Shiow Laang Rd., Jong Her City, Taipei (TW)

( * ) Notice: Subject to any disclaimer, the term of this patent is extended or adjusted under 35 U.S.C. 154(b) by 0 days.

(21) Appl. No.: 09/818,949

(22) Filed: Mar. 27, 2001

(65) Prior Publication Data

US 2002/0139231 A1 Oct. 3, 2002

(51) Int. Cl.[7] ..... B26F 1/02
(52) U.S. Cl. ..... 83/633; 83/634; 83/686
(58) Field of Search ..... 83/633, 686, 167, 83/634, 687; 403/294, 348, 353, 354, 374, 374.5

(56) References Cited

U.S. PATENT DOCUMENTS

| | | | | | |
|---|---|---|---|---|---|
| 1,541,188 | A | * | 6/1925 | Salt | 83/633 |
| 2,017,195 | A | * | 10/1935 | Anderson et al. | 83/633 |
| 3,385,152 | A | | 5/1968 | Brown et al. | |
| 3,459,084 | A | | 8/1969 | Schlafly | |
| 3,714,857 | A | * | 2/1973 | Stuertz et al. | 83/468 |
| 3,785,233 | A | | 1/1974 | Robinson | |
| 4,036,088 | A | | 7/1977 | Ruskin | |
| 4,594,927 | A | * | 6/1986 | Mori | 83/620 |
| 4,637,741 | A | * | 1/1987 | Gillet | 384/439 |
| 4,713,995 | A | | 12/1987 | Davi | |
| 5,286,129 | A | * | 2/1994 | French et al. | 403/24 |
| 5,749,278 | A | * | 5/1998 | Lee et al. | 83/588 |
| D406,606 | S | * | 3/1999 | Lee | D19/72 |
| D407,752 | S | * | 4/1999 | Kim et al. | D19/72 |
| 6,089,137 | A | * | 7/2000 | Lee | 83/621 |
| 6,109,155 | A | * | 8/2000 | Huang | 83/628 |
| D433,062 | S | * | 10/2000 | Ho | D19/72 |

* cited by examiner

*Primary Examiner*—Kenneth E. Peterson
*Assistant Examiner*—Omar Flores-Sánchez
(74) *Attorney, Agent, or Firm*—Sofer & Haroun, LLP

(57) ABSTRACT

A mold-pressing device including a seat body formed with a horizontal fissure at one end and a vertical chamber communicated with the fissure. A mold block is disposed in the chamber. One face of the mold block is disposed with a solid die, while the other face of the mold block is disposed with a channel passing through the mold block. A pressing lever is pivotally disposed in the channel of the mold block. A housing covers the seat body and is formed with a window for a pressing section of the pressing lever to extend therethrough. In use, a paper or a sheet is pushed into the fissure of the seat body and then the pressing section of the pressing lever is depressed, whereby a protuberance of the pressing lever is moved downward to force the mold block downward with the die punching the paper or the sheet placed in the fissure. Therefore, a product with a shape as that of the die is formed.

13 Claims, 3 Drawing Sheets

MOLD-PRESSING DEVICE

FIELD OF THE INVENTION

The present invention relates to a mold-pressing device in which a mold block is movably disposed in a seat body and is moved therein by a pressing lever.

BACKGROUND OF THE INVENTION

As explained in U.S. Pat. No. 5,749,278—which is fully incorporated herein by reference—generally, when it is desired to create a large amount of identical paper shapes, first many sheets are stamped with a mold painted with ink. Following the stamped lines, shapes can then Cut out using a knife or a pair of scissors. Such a procedure is very troublesome and waste-consuming. Alternatively, many papers can be stacked and cut at once to save time. However, in the case that the paper has a considerable thickness or the shape is too small, it is often difficult to cut out the shape with smooth edges.

Typically, as described in the above-mentioned patent, a mold pressing device is used to speed the task of punching shapes from paper sheets. Such a device includes a pressing lever that is pivotally disposed on a seat body for pressing a mold block. The seat body is formed with a fissure and the mold block is formed with a die. A paper or a sheet can be pushed into the fissure of the seat body and then the pressing section of the pressing lever is depressed. This causes the mold block to be forced downward resulting in the die punching the paper or the sheet placed in the fissure. Therefore, many products with a shape as that of the die can be formed.

The assembly of a mold pressing device—such as the one described in the above-mentioned patent—can be relatively time consuming because of the need to mate the seat body, the mold block, and the pressing lever. Ideally, assembly does not require additional steps such as depressing the mold body in order to couple the lever to the seat body. At the same time, the lever must be securely coupled to the mold body.

OBJECTS AND SUMMARY OF THE INVENTION

It is therefore a primary object of the present invention to provide an improved mold-pressing device that is relatively simple to assemble.

It is another object of the present invention to provide a mold-pressing device including a seat body formed with a horizontal fissure and a vertical chamber communicated with the fissure. A mold block is disposed in the chamber. One face of the mold block is disposed with a solid die, while the other face of the mold block is disposed with a channel passing through the mold block. A pressing lever is pivotally disposed in a hook retainer in the channel of the mold block. A housing covers the seat body and is formed with a window for a pressing section of the pressing lever to extend therethrough. In use, a paper or a sheet is pushed into the tissure of the seat body and then the pressing section of the pressing lever is depressed to force the mold block downward with the die punching the paper or the sheet placed in the fissure. Therefore, a product with a shape as that of the die is formed.

It is a further object of the present invention to provide the above mold-pressing device in which a resilient member is fitted under the mold block in the chamber of the seat body.

After the mold block is released from the pressing force of the pressing lever, the resilient member serves to restore the mold block to its home position.

It is still a further object of the present invention to provide the above mold-pressing device in which the mold block is replaceably placed on the seat body, whereby the mold block can be easily replaced by another mold block to manufacture different products.

The above description sets forth rather broadly the more important features of the present invention in order that the detailed description thereof that follows may be understood, and in order that the present contributions to the art may be better appreciated. Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

BRIEF DESCRIPTION OF THE DRAWINGS

In the drawings in which like reference characters denote similar elements throughout the several views.

DETAILED DESCRIPTION OF THE INVENTION

Figure 1:
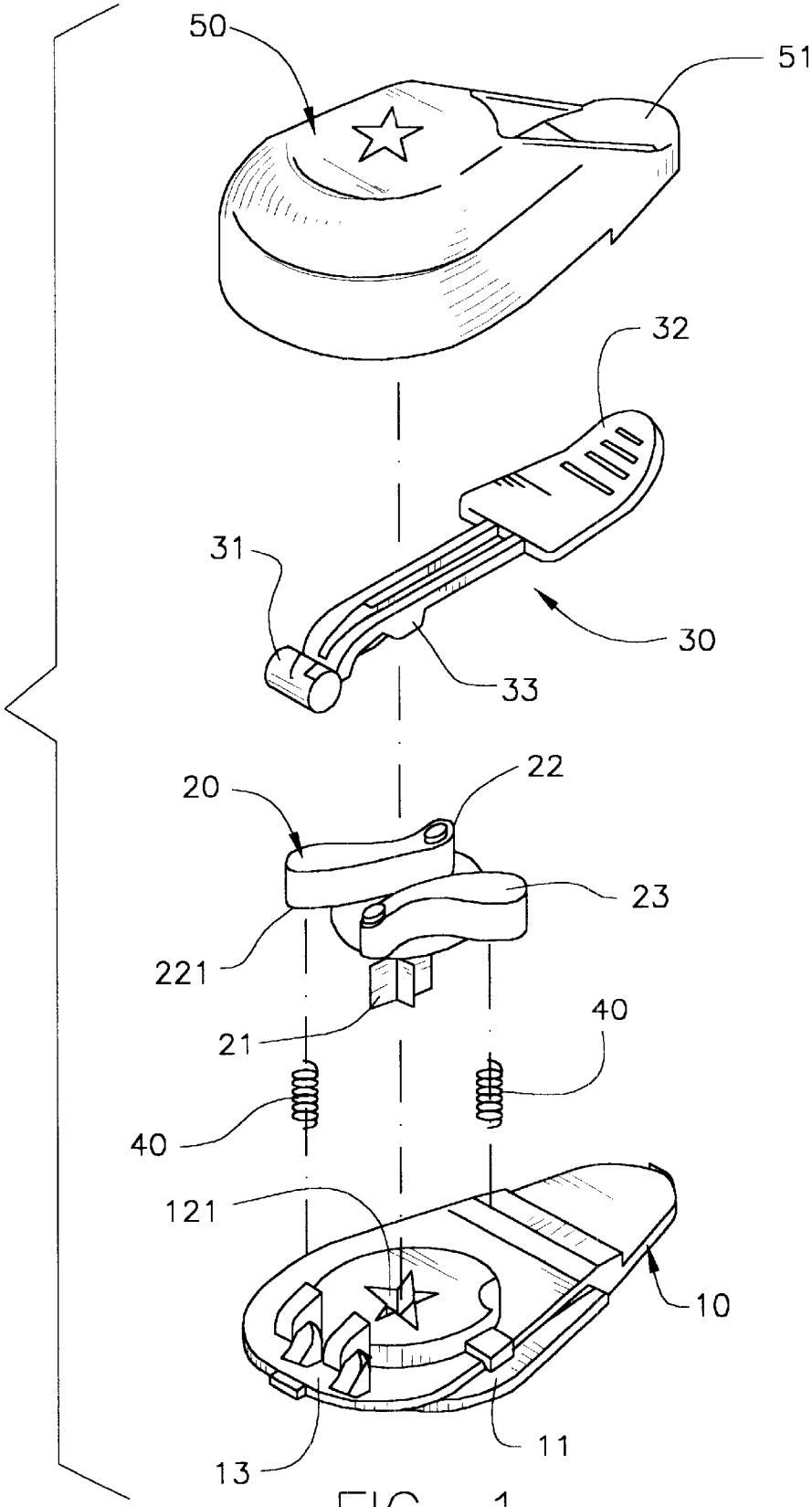
FIG. 1 is a perspective exploded view of the present invention.
Figure 2:
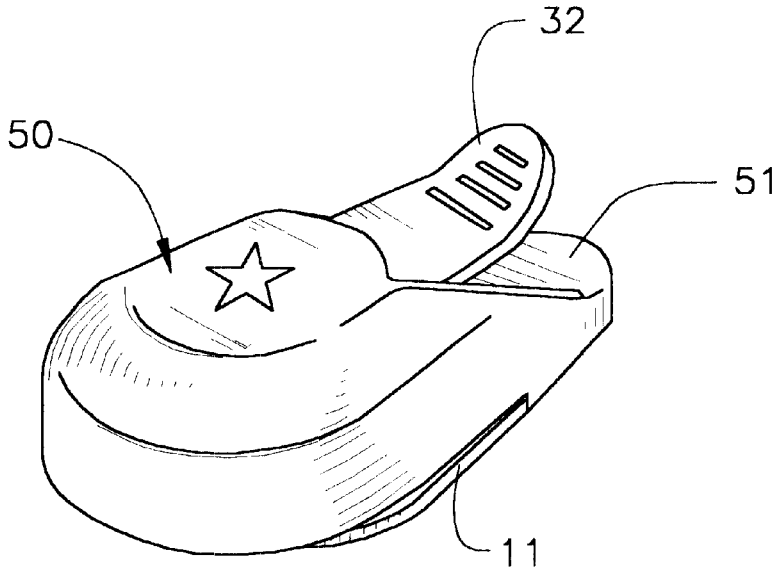
FIG. 2 is a perspective assembled view of the present invention.
Figure 3:
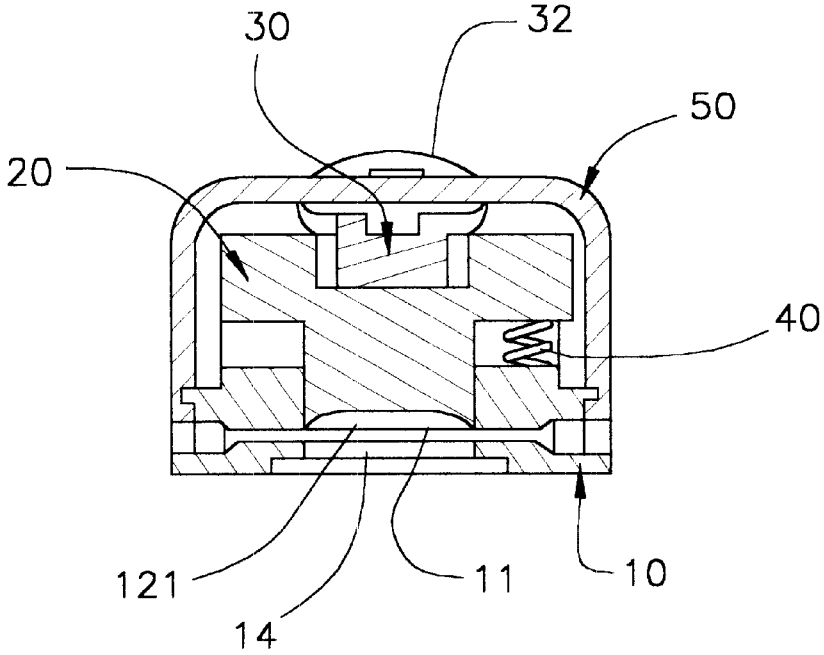
FIG. 3 is a front sectional view of the present invention, wherein the pressing lever is not pressed downward.

Now referring to FIGS. 1 to 5, and specifically to FIG. 1, the mold-pressing device of the present invention includes a seat body 10 formed with a horizontal fissure 11 at one end and a vertical opening 121 which communicates with the fissure 11. A hook retainer 13, preferably comprising two hook-shaped projections is positioned on the front portion of seat body 10. The bottom of seat body 10 is formed with a through hole 14 which communicates with the fissure 11 opposite to the opening 121.

A mold block 20 is disposed on the seat body 10. One face of the mold block 20 tacitly the fissure 11 is disposed with a solid die 21 such as an animal or a cartoon picture. The other face of the mold block 20 is disposed with a channel 22 passing through the mold block 20 forming walls 22 and 23.

A pressing lever 30 is disposed in the mold block 20. One end of the pressing lever 30 is disposed with a pivot shaft 31 having first and second pivotends 31*a*, 31*b* for rotatably inserting in hook retainer 13 of the seat body 10, whereby the pressing lever 30 is pivotally disposed on the seat body 10. The other end of the pressing lever 30 is disposed with an upward bent pressing section 32. In addition, the pressing lever 30 is formed with a protuberance 33 extending in a direction reverse to that of the pressing section 32 for fitting in the channel 22 of the mold block 20.

Figure 5:
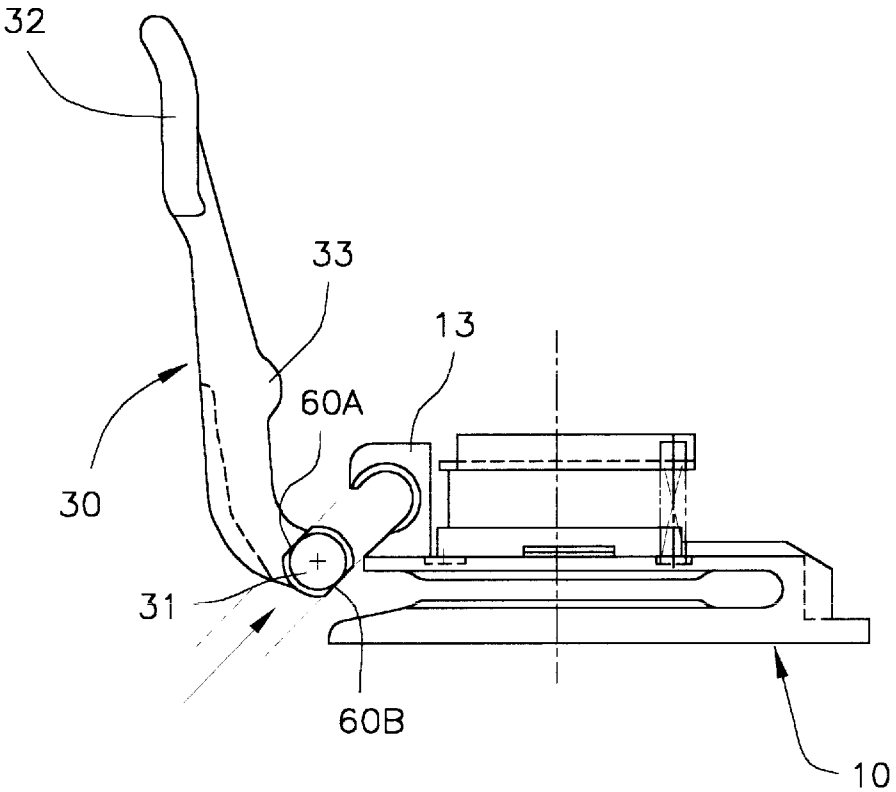
FIG. 5 is a side sectional view according to FIG. 4, wherein the pressing lever is not coupled to the seat body.
Figure 4:
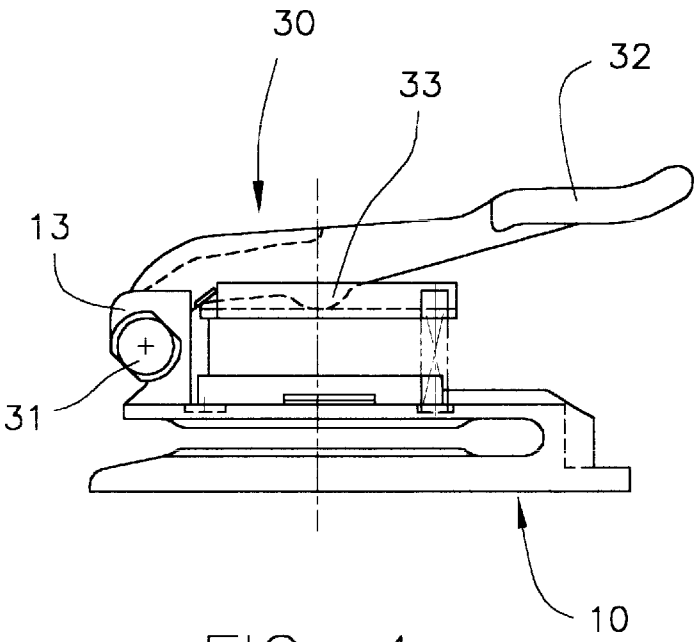
FIG. 4 is a side sectional view of the present invention, wherein the pressing lever is coupled to the seat body.

Now turning to FIGS. 4 and 5, which show hook retainer 13 in more detail, the assembly process can be described. To begin, it is noted that in one embodiment, pivot shaft 31 is cylindrical in shape with two faces 60*a* and 60*b*. By appropriately sizing, hook retainer 13, pivot shaft 13 may only be inserted into retainer 13 at one angle where faces 60*a* and 60*b* allow shaft 31 to pass into retainer 13. By rotating lever 30, shaft 31 becomes captured retainer 13. This provides for a secure fitting as lever 30 can only be removed when it is rotated to the angle which properly aligns faces 60*a* and 60*b*. At the same time, this set-up avoids difficulties seen in previous designs where assembly is complicated by an alternate means for joining a lever to a seat body.

At least one resilient member 40 is fitted under the projection 23 of the mold block 20. A reccess may be provided in walls 22 and 23 to help retain each resilient member 40.

A housing 50 covers the seat body 10 and is formed with a window 51, whereby the pressing section 32 of the pressing lever 30 can extends through the window 51 out of the In use a paper or a sheet is horizontally placed in the fissure 11 of the seat body 10 and pushed inward to a true position. Then the pressing section 32 of the pressing lever 30 is pivotally depressed about the pivot shaft 31, whereby the protuberance 33 of the pressing lever 30 is moved downward to exert a force onto the mold block 20. Accordingly, the mold block 20 is forced downward with the die 21 passing through the opening 121 to punch the paper or the sheet placed in the fissure 11. Therefore, a product of the paper or sheet is formed having the same shape as that of die 21. Once the product is punched, it continues moving along with the downward moving die 21 into the through hole 14 and eventually out of the mold-pressing device. The resilient member 40 serves to restore the mold block 20 to its home position. At this time, the pressing section 32 of the pressing lever 30 is moved upward along with the mold block 21 to its home position. The above operation can be repeatedly performed to manufacture many products.

It is to be understood that the above description and drawings are only used for illustrating one embodiment of the present invention and is not intended to limit the scope thereof. Any variation and derivation from the above description and drawings should be included in the scope of the present invention.

What is claimed is:

1. A punch for punching a sheet of material, said punch comprising:

a body formed with a fissure for receiving the sheet of material;

first and second hook retainers defining a pivot axis, said first and second hook retainers mounted on said body and spaced apart to define an intermediate gap;

a lever having a pivot shaft with first and second pivot ends, said first and second pivot ends pivotably mounted within said first and second hook retainers, said lever disposed in said intermediate gap between said first and second hook retainers;

a block positionable between said lever and said body, said block having a die moveable along a first axis;

at least one resilient member adjacent to said die along a second axis spaced apart from said first axis, and disposed between said block and said body, wherein when said block is positioned between said lever and said body and when said lever mounted in said intermediate gap is pivoted about said pivot axis between a first position and a second position, said lever engages said axially moveable die to punch the sheet of material; and wherein said hook retainers are provided with openings, said openings facing a direction opposite said block, so that when said lever is inserted into said openings of said first and second retainer hooks, said lever is prevented from moving in a direction opposite said openings.

2. The punch according to claim 1, wherein said punch is sufficiently compact so as to be operable by holding an end of said body with a user's forefinger and by holding an end of said lever opposite said pivot point with said user's thumb.

3. The punch according to claim 1, wherein said pivot shaft of said lever further includes at least one face, said at least one face configured to allow said shaft to enter said hooks of said hook retainer when said shaft is at one angle of a shaft axis so that said hook retainer captures said shaft when said shaft is rotated from said one angle.

4. The punch according to claim 1, wherein said least one resilient member comprises first and second oppositely disposed springs adjacent to said die, said first spring disposed along said second axis and said second spring disposed along a third axis, said third axis spaced apart from said first and second axes.

5. The punch according to claim 1, wherein said fissure is substantially perpendicular to said first axis.

6. The punch according to claim 5, wherein said body has an opening which communicates with said fissure.

7. The punch according to claim 6, wherein said opening has a shape that corresponds to said die.

8. The punch according to claim 5, wherein said body has a pair of aligned openings which communicate with said fissure.

9. The punch according to claim 8, wherein each of said pair of opening has a shape that corresponds to said die.

10. The punch according to claim 1, wherein said block further comprises a channel configured to receive said lever.

11. The punch according to claim 10, wherein said housing provides an indication corresponding to a shape of said die.

12. The punch according to claim 1, wherein said punch further comprises a housing which houses said block when positioned between said body and said lever.

13. The punch according to claim 12, wherein said lever extends through said housing.

* * * * *